US010391609B1

(12) United States Patent
Cahill et al.

(10) Patent No.: US 10,391,609 B1
(45) Date of Patent: Aug. 27, 2019

(54) MODULAR CONTACT ASSEMBLY FOR ROTATING MACHINE TOOL

(71) Applicant: OptiPro Systems, LLC, Ontario, NY (US)

(72) Inventors: Michael J. Cahill, West Henrietta, NY (US); Travis Smith, Ontario, NY (US); Robert Bechtold, Ontario, NY (US); Michael Bechtold, Ontario, NY (US)

(73) Assignee: OptiPro Systems, LLC, Ontario, NY (US)

( * ) Notice: Subject to any disclaimer, the term of this patent is extended or adjusted under 35 U.S.C. 154(b) by 96 days.

(21) Appl. No.: 15/695,937

(22) Filed: Sep. 5, 2017

(51) Int. Cl.
*B24B 47/12* (2006.01)
*B24B 1/04* (2006.01)

(52) U.S. Cl.
CPC ..... *B24B 47/12* (2013.01); *B24B 1/04* (2013.01)

(58) Field of Classification Search
CPC ..... B24B 47/12; B24B 1/04; H01R 39/02; H01R 39/04; H01R 39/085; H01R 39/42; H01R 39/44; B23B 37/00; B23B 2270/10; B23B 29/125; B23C 2270/10; Y10S 82/904
USPC ..... 451/156, 165; 310/219, 238–239; 318/541; 322/53, 54; 439/1
See application file for complete search history.

(56) References Cited

U.S. PATENT DOCUMENTS 1,509,666 A * 9/1924 Campbell ..... H01R 39/38 310/245
2,452,211 A * 10/1948 Rosenthal ..... B21B 11/00 125/30.02
2,632,858 A * 3/1953 Calosi ..... B06B 3/00 310/26
2,818,686 A * 1/1958 Weiss ..... B23Q 1/34 175/56
2,825,186 A * 3/1958 Palush ..... B24B 1/04 310/26
2,967,381 A * 1/1961 Brown ..... B24B 1/04 125/12
3,316,519 A * 4/1967 Maytone ..... H01R 39/00 310/227
3,339,098 A * 8/1967 Burrows ..... H01R 39/40 310/239
3,387,155 A * 6/1968 Krulls ..... H02K 5/14 310/239

(Continued)

*Primary Examiner* — George B Nguyen
(74) *Attorney, Agent, or Firm* — John M. Hammond; Patent Innovations LLC

(57) ABSTRACT

A modular contact assembly for transferring electrical energy from a fixed object to a rotating object, and a machine tool that includes the contact assembly. The machine tool may include a housing, a rotating spindle mounted in the housing, and an electrical device mounted in the rotating spindle. The contact assembly includes a mounting plate joinable to a housing by movement of the plate into an attached position on the housing; a first brush assembly, first and second electrical contacts disposed in the mounting plate, an actuator joined to the mounting plate, and a first energy supply connection disposed in the mounting plate and in communication with the actuator. The machine tool may also include a magnet that is rotatable a quarter turn to retain the contact assembly in the machine tool. The electrical device may be an ultrasonic transducer operable to perform ultrasonic machining by the tool.

15 Claims, 8 Drawing Sheets

(56) References Cited

U.S. PATENT DOCUMENTS 3,699,719 A * 10/1972 Rozdilsky ..... B24B 1/04 451/165
3,908,142 A * 9/1975 Gaudry ..... H01R 39/40 310/242
4,297,605 A * 10/1981 Tak ..... H01R 39/41 310/242
4,739,208 A * 4/1988 Kimberlin ..... H01R 39/58 200/61.4
4,934,103 A * 6/1990 Campergue ..... B24B 1/04 451/165
5,062,187 A * 11/1991 Bromley ..... B23B 29/02 29/33 T
5,155,944 A * 10/1992 Nagel ..... B24B 33/02 451/156
5,177,904 A * 1/1993 Nagel ..... B24B 33/06 451/156
5,245,796 A * 9/1993 Miller ..... B24B 37/107 438/692
5,303,510 A * 4/1994 Calkins ..... B23Q 5/027 451/165
5,305,556 A * 4/1994 Kopp ..... B06B 3/00 451/124
5,361,543 A * 11/1994 Bory ..... B06B 3/02 451/155
5,404,680 A * 4/1995 Mizuguchi ..... B23Q 1/34 451/1
5,447,485 A * 9/1995 Bory ..... B23B 31/11 409/233
5,474,488 A * 12/1995 Yamamoto ..... B24B 1/04 451/165
5,597,345 A * 1/1997 Young ..... B06B 3/02 451/165
5,661,357 A * 8/1997 Iijima ..... H01R 39/38 310/239
5,733,074 A * 3/1998 Stock ..... B23B 37/00 408/129
5,885,132 A * 3/1999 Meyer ..... B24B 49/18 451/5
6,054,777 A * 4/2000 Soh ..... F02N 11/00 290/38 R
6,612,906 B2 * 9/2003 Benderly ..... B24B 1/04 451/165
7,824,247 B1 * 11/2010 Bar-Cohen ..... B23B 37/00 125/28
9,878,377 B2 * 1/2018 Short ..... B23B 37/00
2006/0229004 A1 * 10/2006 Ohnishi ..... B24B 1/04 451/165
2016/0129542 A1 * 5/2016 Chen ..... B24B 1/04 451/37

* cited by examiner

MODULAR CONTACT ASSEMBLY FOR ROTATING MACHINE TOOL

STATEMENT REGARDING FEDERALLY SPONSORED RESEARCH OR DEVELOPMENT

This invention was made with United States Government support. The U.S. Government has a paid-up license in this invention and the right under limited circumstances to require the patent owner to license others on reasonable terms as provided for by the terms of Contract No. N68936-15-C-0008 awarded by the Naval Air Systems Command of the United States Department of Defense.

BACKGROUND

Technical Field

Precision machining of hard materials including metals, ceramics, and glasses, using ultrasonic energy, and ongoing operation and maintenance of tooling for machining.

Description of Related Art

In the fabrication of optical components, such as lenses, prisms, mirrors, and other devices, optical glass may be machined using a machine tool, which includes a tool bit that rotates at high speed, and that is also oscillated at a frequency typically in the ultrasonic range. The tool bit may be held in a tool holder that is inserted into a spindle assembly, which provides the rotational motion of the tool bit. In machining processes that also use ultrasonic energy, the tool holder may also contain a piezoelectric transducer that is connected to an electrical power supply. The power supply causes the piezo transducer to oscillate axially and radially along the spindle axis. The piezo transducer is also mechanically connected to the tool bit, and thus causes the tool bit to oscillate at ultrasonic frequency as it contacts the surface of the material to be machined. Enhanced machining results from the use ultrasound in vibrating the tool bit in addition to rotating it.

In order to supply the alternating voltage to the piezoelectric transducer (which is contained in the rotating part of the tool holder), a pair of electrically conductive brushes is used. The brushes are connected to an alternating voltage supply contained in a stationary housing of the mill, and the brushes are in contact with respective rotating terminal surfaces of a slip ring power coupling, which in turn are connected to the piezoelectric transducer.

However, in the operation of the machining center, the brushes wear down, and must be replaced. In currently practiced machining processes known to the Applicant, the task of changing the brushes is time consuming, complex, labor intensive, and requires a high degree of skill. A substantial amount of the lower portion of the spindle must be disassembled in order to gain access to the brushes, and then further disassembly must be done to remove the brushes, including disconnection of electrical wiring, removal of various fasteners, and disconnection of energy sources to actuators that are operable to move the brushes into and out of electrical contact position. The reverse procedure must be followed in order to install new brushes. This procedure typically takes an hour or more, which, given the cost of downtime in a manufacturing operation, is a significant expense.

What is needed is a device and associated methods that enable simple, rapid, and reliable removal and replacement of worn brushes in an ultrasonically enhanced machine tool.

SUMMARY

In accordance with the present disclosure, the problem of removal and replacement of worn brushes in an ultrasonic machine tool is solved by a modular contact assembly that can be quickly removed from the machine tool, and replaced with a duplicate modular electrical contact assembly that has new brushes. The modular contact assembly is not limited in its use to ultrasonic machine tools. The assembly is adaptable to other machine tools that include other electrical devices, sensors, and instruments.

In general, a machine tool that is operable with the contact assembly is comprised of a housing, a rotating spindle mounted in the housing, and an electrical device mounted in the rotating spindle. In certain embodiments, the electrical device may be an ultrasonic transducer that is operable to oscillate a machine tool bit, thereby enhancing the material removal capability of the tool bit.

The contact assembly is comprised of a mounting plate joinable to the housing by movement of the plate into an attached position on the housing; a first brush assembly, first and second electrical contacts disposed in the mounting plate, an actuator joined to the mounting plate, and a first energy supply connection disposed in the mounting plate and in communication with the actuator. The first brush assembly is joined to the mounting plate and comprises a first conductive brush movable with respect to the mounting plate and a second conductive brush movable with respect to the mounting plate. The first and second electrical contacts are in electrical communication with the first conductive brush and the second conductive brush, respectively. The actuator is operable to move the first conductive brush into electrical contact with a first rotating electrical contact ring in electrical communication with a first electrical terminal of the electrical device, and operable to move the second conductive brush into electrical contact with a second rotating electrical contact ring in electrical communication with a second electrical terminal of the electrical device, when the mounting plate (and overall contact assembly) is in the attached position. When the mounting plate is moved from a detached position to the attached position and is joined to the housing of the machine tool, the first electrical contact disposed in the mounting plate is electrically connected with a first mating electrical contact disposed in the housing of the machine tool, the second electrical contact disposed in the mounting plate is electrically connected with a second mating electrical contact disposed in the housing of the machine tool, and the first energy supply connection disposed in the mounting plate is connected to a first mating energy supply connection disposed in the housing of the machine tool.

In certain embodiments, the actuator may be a fluidic actuator, i.e., an actuator operable by delivering fluid under pressure into an actuator body to drive a member in a first direction, and withdrawing fluid under vacuum from the actuator body to drive the member in a second direction opposite the first direction. In such embodiments, the first energy supply connection may be comprised of a first tubing connector disposed in the mounting plate and connectable with a first mating tubing connector disposed in the housing of the machine tool. The fluid may be a compressible fluid, i.e., a gas such as air, in which case the fluid actuator is a pneumatic actuator, such as a pneumatic cylinder. Alternatively, the fluid may be an incompressible fluid, i.e., a liquid, in which case the fluid actuator is a hydraulic actuator, such as a hydraulic cylinder.

The contact assembly may be further comprised of a second energy supply connection disposed in the mounting plate and in communication with the actuator. In such embodiments, when the mounting plate is moved from the detached position to the attached position and is joined to the housing of the machine tool, the second energy supply connection disposed in the mounting plate is connected with a second mating energy supply connection disposed in the housing of the machine tool. In such embodiments in which the actuator is a pneumatic or hydraulic actuator, the first energy supply connection may be comprised of a first tubing connector disposed in the mounting plate and connectable with a first mating tubing connector disposed in the housing of the machine tool, and the second energy supply connection may be comprised of a second tubing connector disposed in the mounting plate and connectable with a second mating tubing connector disposed in the housing of the machine tool.

In other embodiments, the actuator may be an electrically operated actuator, such as a solenoid, or an electric motor. The actuator, whether fluidic or electrically operated, may be a linear actuator or a rotary actuator.

In certain embodiments, the first brush assembly of the contact assembly may be comprised of a first arm including a proximal end pivotably joined to the mounting plate and a distal end joined to the first conductive brush, and a second arm including a proximal end pivotably joined to the mounting plate and a distal end joined to the second conductive brush.

In certain embodiments, the contact assembly may be further comprised of a third electrical contact disposed in the mounting plate. In such embodiments, when the mounting plate is moved from the detached position to the attached position and is joined to the housing of the machine tool, the third electrical contact disposed in the mounting plate is electrically connected with a third mating electrical contact disposed in the housing of the machine tool. In further embodiments, the contact assembly may include additional electrical contacts disposed in the mounting plate that are connectable with additional respective mating electrical contacts disposed in the housing of the machine tool.

In certain embodiments, the mounting plate may include a magnetic material. In such embodiments, the mounting plate may be removably joinable to the housing of the machine tool by movement of a magnet on the housing proximate to the mounting plate. In another embodiment, the mounting plate may be provided with a surface that is contiguous with a vacuum source on the machine tool. When the contact assembly is in the attached position on the machine tool, the vacuum source may be actuated, thereby applying a force on the contact assembly to retain it in the attached position. Other manners of applying a retaining force on the contact assembly are contemplated.

Also according to the present disclosure, a machine tool is provided comprising a contact assembly as described above, and in further detail subsequently herein.

BRIEF DESCRIPTION OF THE DRAWINGS

The present disclosure will be provided with reference to the following drawings, in which like numerals refer to like elements, and in which.

Figure 1:
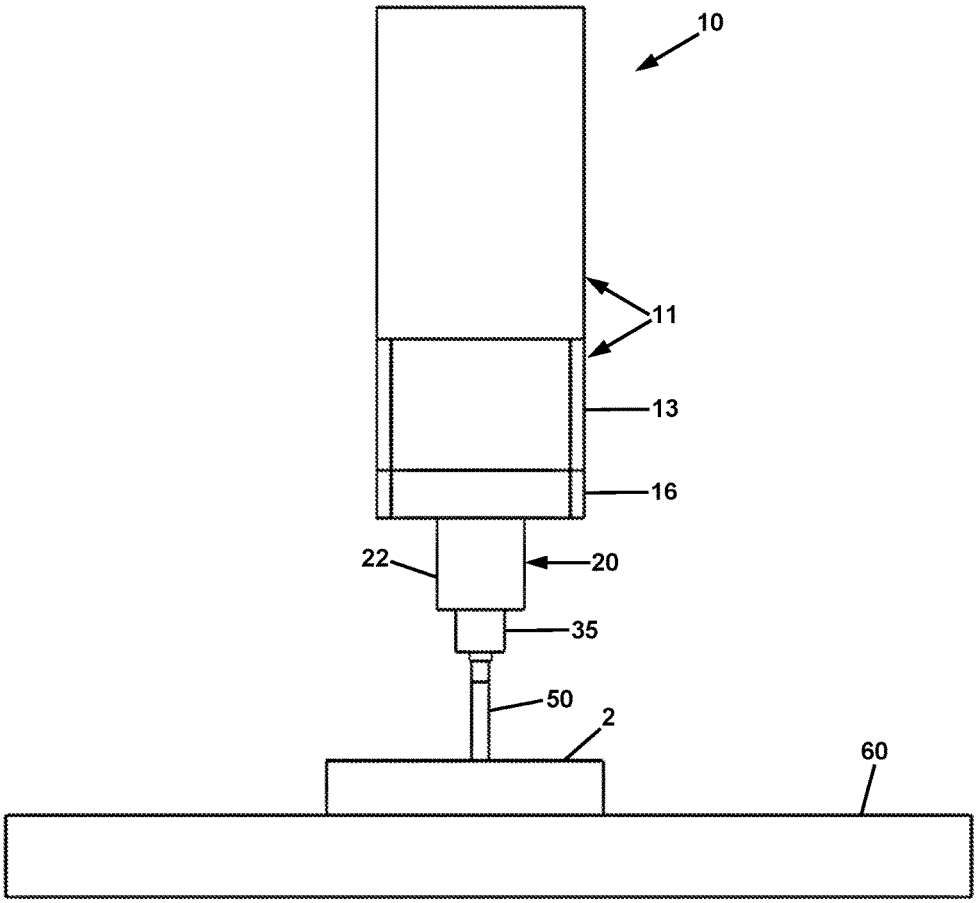
FIG. 1 is a side elevation view of an ultrasonically enhanced machine tool performing a machining operation on a work piece.

The present invention will be described in connection with certain preferred embodiments. However, it is to be understood that there is no intent to limit the invention to the embodiments described. On the contrary, the intent is to cover all alternatives, modifications, and equivalents as may be included within the spirit and scope of the invention as defined by the appended claims.

DETAILED DESCRIPTION

For a general understanding of the present invention, reference is made to the drawings. In the drawings, like reference numerals have been used throughout to designate identical elements. The drawings are to be considered exemplary, and are for purposes of illustration only. The dimensions, positions, order and relative sizes reflected in the drawings attached hereto may vary.

In the following disclosure, the present invention is described in the context of its use as a modular contact assembly for a machine tool having a rotating spindle mounted in the housing, and an electrical device mounted in the rotating spindle, and in particular, wherein the electrical device is an ultrasonic transducer operable to perform ultrasonically assisted machining of a workpiece. However, the present invention is not to be construed as being limited only to use in ultrasonic machining applications, or only in machine tools. The invention is adaptable to any use in which a simple and rapid change of electrical contacts is desirable to be provided from an electrical contact assembly. Additionally, the description may identify certain components with the adjectives "top," "upper," "bottom," "lower," "left," "right," etc. These adjectives are provided in the context of use of the contact assembly in a machine tool, and in the context of the orientation of the drawings, which is arbitrary. The description is not to be construed as limiting the contact assembly to use in a particular spatial orientation.

The instant contact assembly may be used in orientations and with apparatus other than those shown and described herein.

It is also to be understood that any connection references used herein (e.g., attached, coupled, connected, and joined) are to be construed broadly and may include intermediate members between a collection of elements and relative movement between elements unless otherwise indicated. As such, connection references do not necessarily imply that two elements are directly connected and in fixed relation to each other.

FIG. 1 is a side elevation view of an ultrasonically enhanced machine tool performing a machining operation on a work piece. The machine tool includes the contact assembly of the present disclosure. In operation of the machine tool, electrical contact "brushes" are worn away, necessitating the removal of the worn brushes, and replacement with new brushes. The contact assembly of the present disclosure is modular and includes the brushes, such that a contact assembly with worn brushes can be quickly and easily removed, and replaced with an identical contact assembly that includes new brushes.

Figure 2:
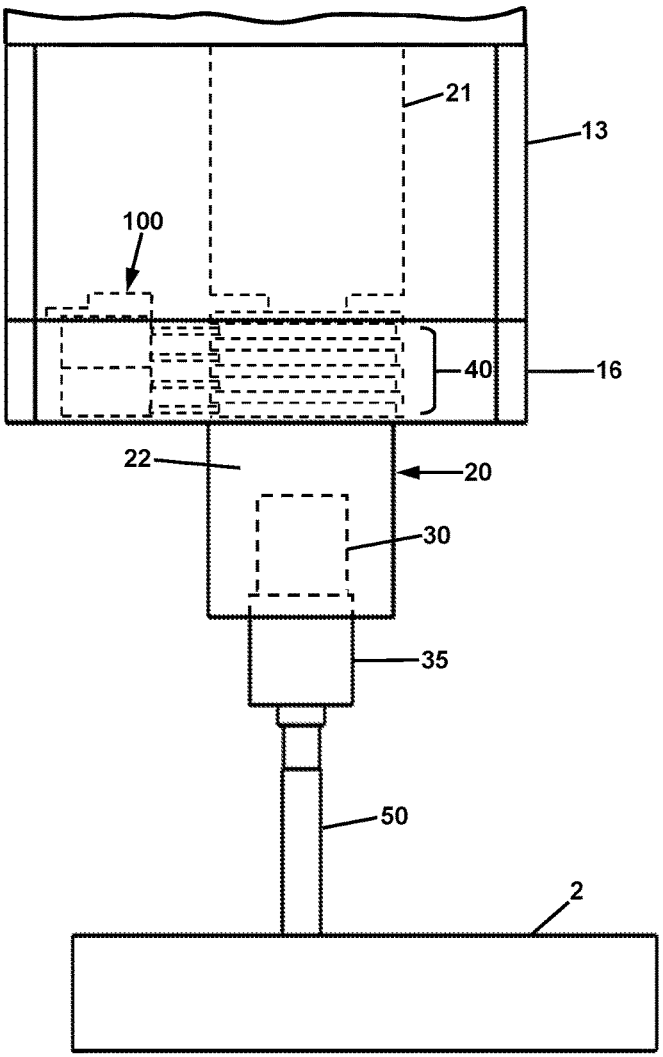
FIG. 2 is a detailed side elevation view of the machine tool and workpiece of FIG. 1.
Figure 3B:
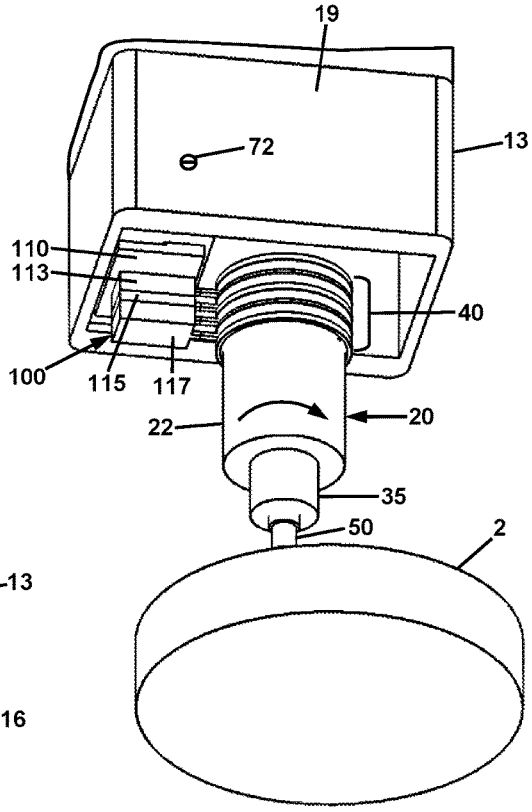
FIG. 3B is a detailed upward perspective view of the machine tool and workpiece of FIG. 3A, but with a base cover of the machine tool removed so as to show the contact assembly of the present disclosure installed on the machine tool.
Figure 3A:
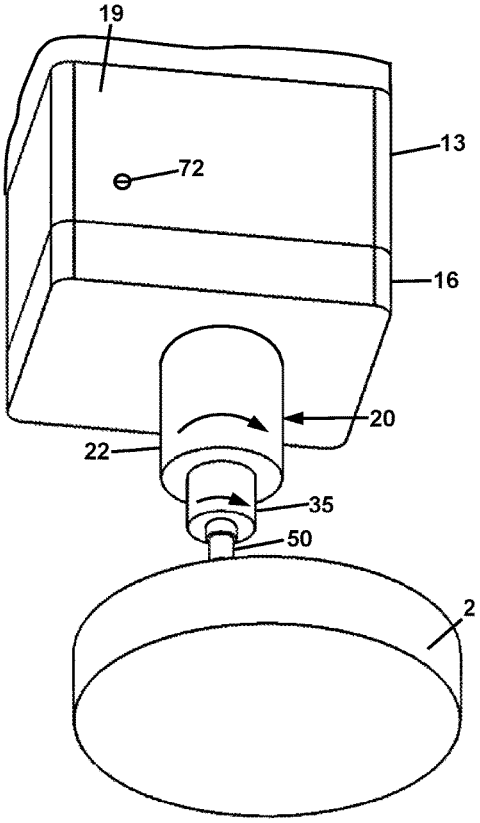
FIG. 3A is a detailed upward perspective view of the machine tool and workpiece of FIG. 2.

FIG. 2 is a detailed side elevation view of the machine tool and workpiece of FIG. 1, and FIG. 3A is a detailed upward perspective view of the machine tool and workpiece of FIG. 2. Referring to FIGS. 1-3A, a machine tool 10 that is operable with the contact assembly 100 is comprised of a housing 11, a rotating spindle 20 mounted in the housing, and an electrical device mounted in the rotating spindle 20. The housing 11 is hollow, having an internal cavity that contains a driven portion 21 of the rotating spindle 20, the electrical device, and the contact assembly 100. The housing 11 is structurally rigid, and may include various structural frame members (not shown) for this purpose. The driven portion 21 of the rotating spindle 20 is carried by bearings (not shown) disposed in the housing. The rotating spindle 20 is further comprised of a lower portion 22 that is partially exposed, and that functions as a tool holder for holding a tool bit 50.

In certain embodiments, the electrical device may be an ultrasonic transducer 30 that is operable to oscillate a machine tool bit 50, thereby enhancing the material removal capability of the tool bit 50. In operation of the machine tool 10, the ultrasonic transducer 30 receives electrical power through the contact assembly 100. The electrical power is delivered through the brushes of the contact assembly 100, which are in contact with respective electrical contact rings 40. At least two of the electrical contact rings 40 are in electrical communication with the ultrasonic transducer 30 via wires or other conductors (not shown) contained within the lower portion 22 of the spindle 20. The ultrasonic transducer 30 converts electrical power received through the contact assembly 100 to mechanical oscillations of an ultrasonic horn 35, which is disposed in the lower end 22 of the rotating spindle 20. The tool bit 50 is rigidly joined to the ultrasonic horn 35, and thus oscillates with the oscillations of the horn 35. In certain embodiments, the tool bit 50 may be integrally formed as a cutting tip at the distal end of the horn 35. For the sake of simplicity of illustration, the ultrasonic horn 35 is depicted as a blunt cylinder in FIGS. 1-3B, but many other shapes and aspect ratios may be used to optimize the degree of oscillation of the horn 35 and tool bit 50.

The housing 11 of the machine tool 10 may be mounted on a rotatable turret (not shown) and a drive system (not shown) that articulates in x-y-z space to provide multi-axis machining capabilities. The machine tool 10 may also include a platform 60 to which a workpiece 2 that is being machined is temporarily joined. The platform 60 may also include a drive system (not shown) to move the workpiece 2 with respect to the tool bit 50 along and/or around multiple axes. In certain embodiments, the workpiece 2 may be maintained stationary, and the tool bit 50 and entire machine tool structure to which it is joined may be moved relative to the workpiece 2. The workpiece 2 to be machined may be made of metal, glass, ceramic, or other solid material that is machinable. In certain embodiments, the workpiece 2 may be an optical element, such as a lens, a prism, a window, or a mirror.

Figure 6A:
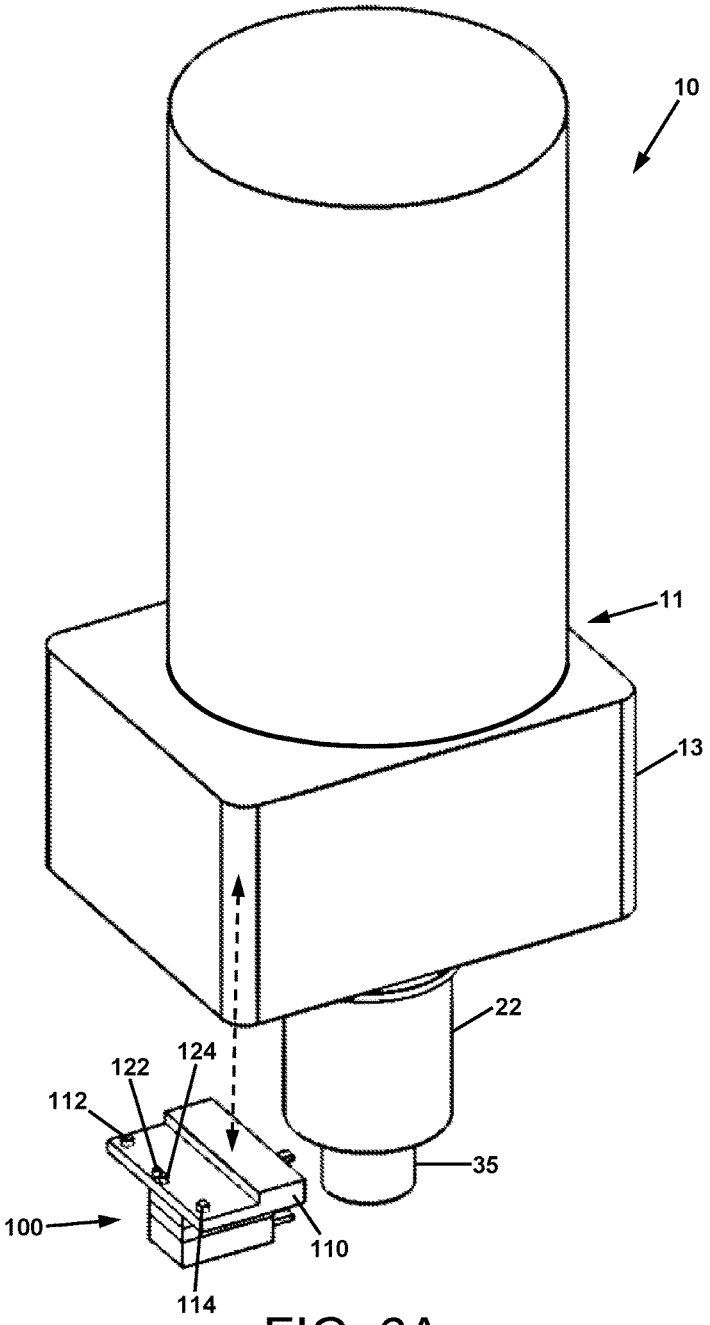
FIG. 6A is an upper perspective view of the machine tool with the modular contact assembly separated therefrom along a vertical axis.
Figure 6B:
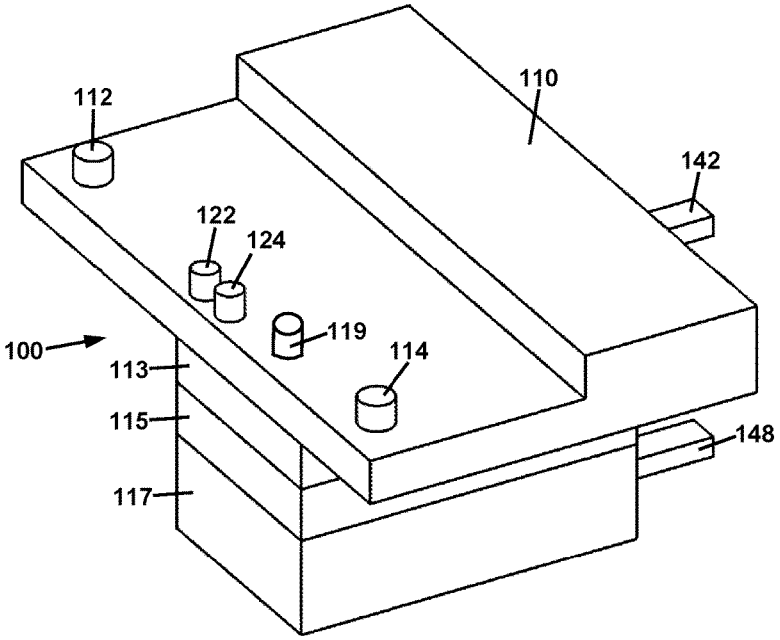
FIG. 6B is a first upper perspective view of the contact assembly.
Figure 6C:
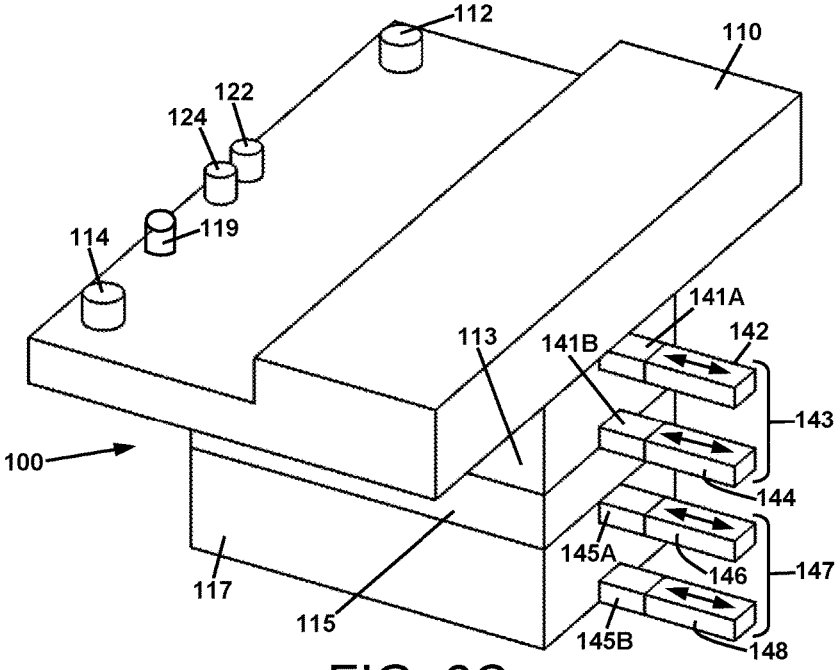
FIG. 6C is a second upper perspective view of the contact assembly.
Figure 7:
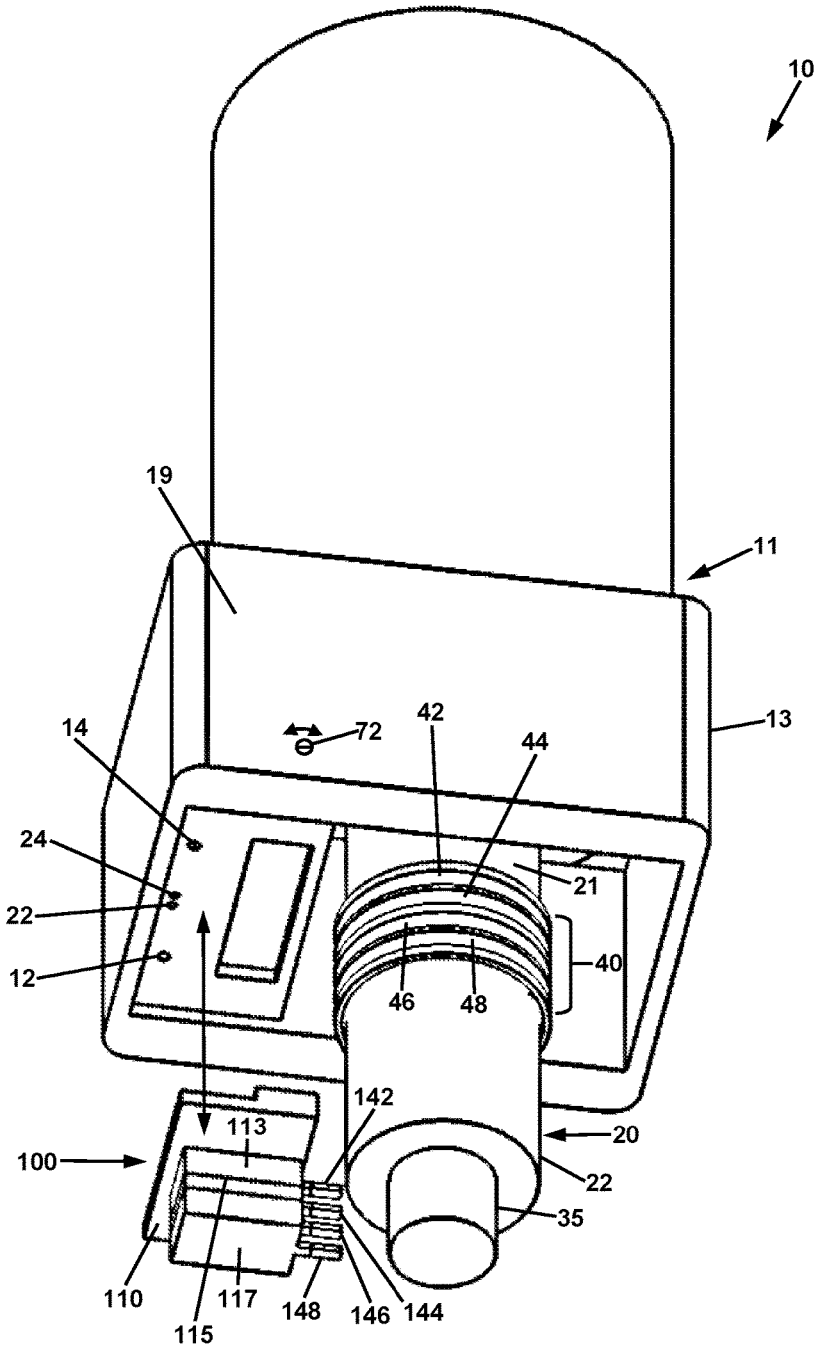
FIG. 7 is a lower perspective view of the machine tool with the modular contact assembly separated therefrom along a vertical axis.

Referring now to FIGS. 3B-7, the contact assembly 100 is comprised of a mounting plate 110 joinable to a lower portion 13 of the housing 11 by movement of the plate 110 into an attached position on the housing 11. FIGS. 2, 3B, 4, and 5A depict the contact assembly 100 in the attached position, and FIGS. 5B, 6A, and 7 depict the contact assembly 100 in a detached position. It is noted that FIG. 3B depicts the machine tool 100 in the same manner and from the same perspective as the machine tool in FIG. 3A, but with a lower cover 16 removed so that the contact assembly 100 can be seen in the attached position.

The contact assembly 100 is comprised of a first brush assembly 143 joined to the mounting plate 110. The first brush assembly 143 comprises a first conductive brush 142 and a second conductive brush 144 movable with respect to the mounting plate 110. The first and second conductive brushes 142 and 144 may be connected to a yoke 141 that is movable with respect to the mounting plate 110. The contact assembly 100 is further comprised of first and second electrical contacts 122 and 124 disposed in the mounting plate 110 but insulated therefrom, and in electrical communication with, i.e. electrically connected to, the first conductive brush 142 and the second conductive brush 144, respectively. The electrical connections may be made with electrical wires (not shown), or by a printed circuit board (not shown) that is joined to the mounting plate 110.

Figure 4:
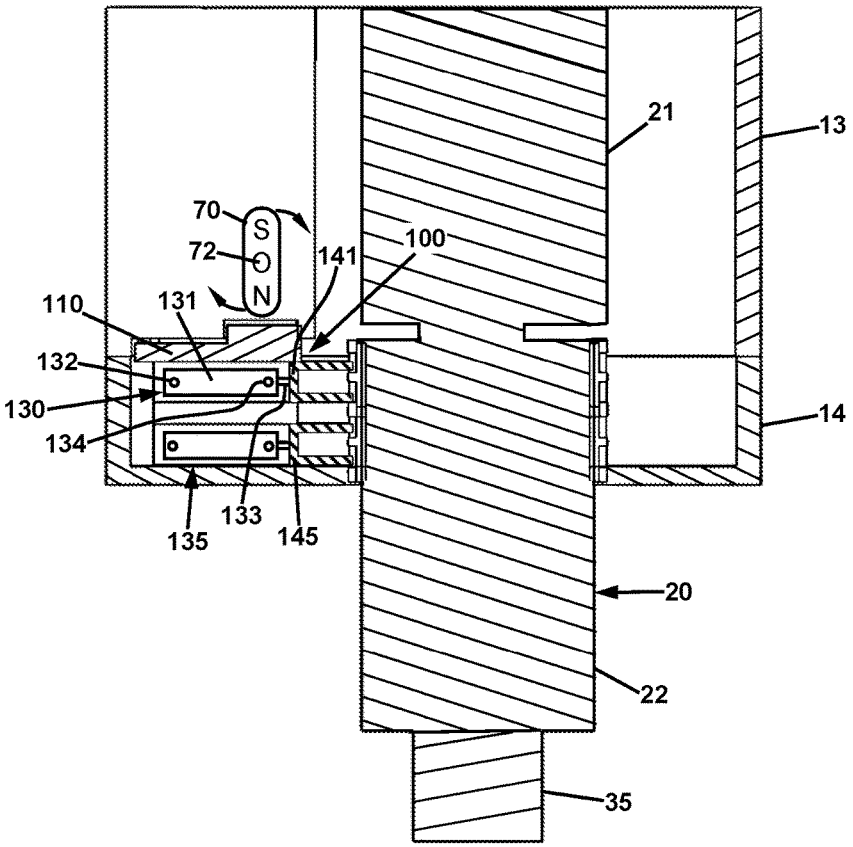
FIG. 4 is a side cross-sectional view of the housing and spindle portions of the machine tool and the contact assembly installed on the machine tool.
Figure 5A:
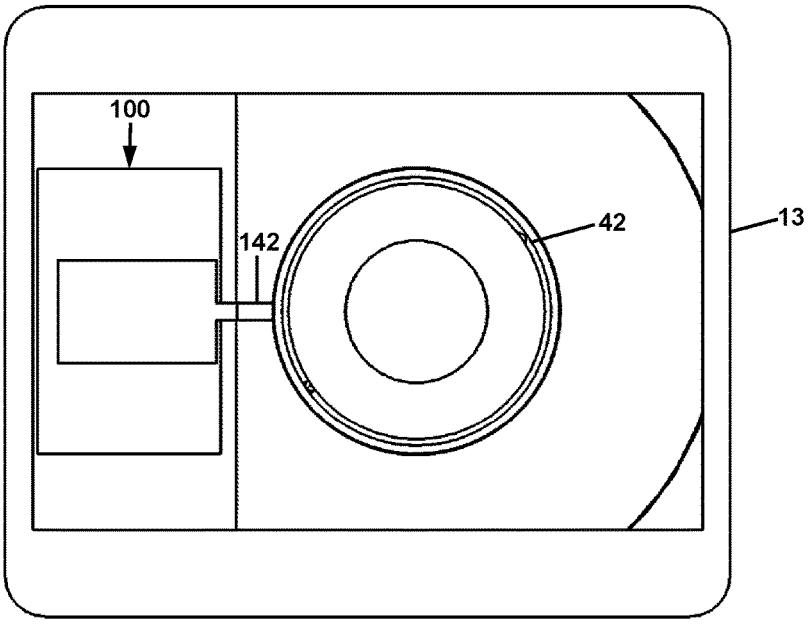
FIG. 5A is an upward orthogonal view of the machine tool with the contact assembly installed on the machine tool.
Figure 5B:
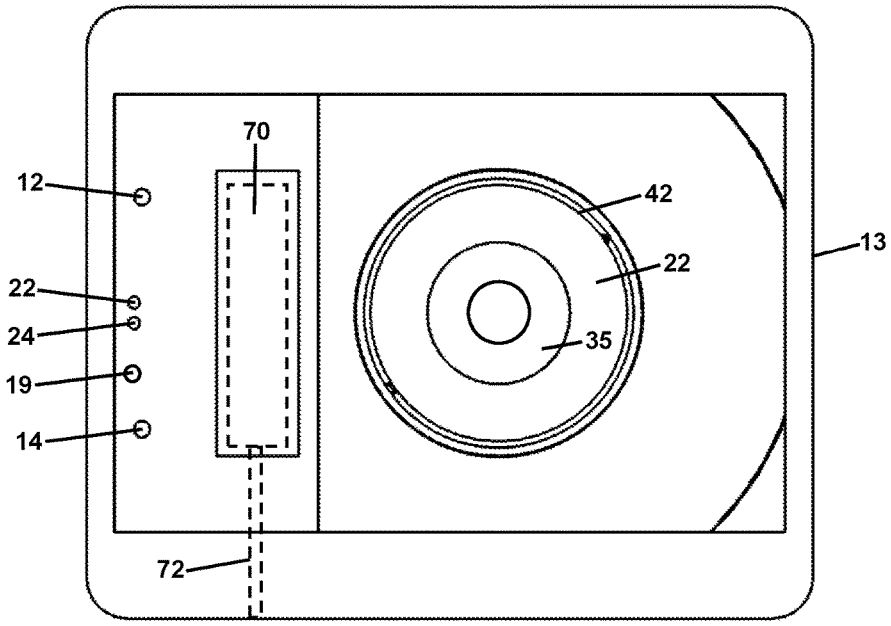
FIG. 5B is an upward orthogonal view of the machine tool with the contact assembly removed therefrom.

The contact assembly 100 is further comprised of an actuator 130 joined to the mounting plate 110, and a first energy supply connection 112 disposed in the mounting plate 110 and in communication with an energy supply connection 132 of the actuator 130. The actuator 130 is operable to move the first conductive brush 142 into electrical contact with a first rotating electrical contact ring 42 that is in electrical communication with a first electrical terminal of the electrical device (in this exemplary embodiment, the ultrasonic transducer 30, and operable to move the second conductive brush 144 into electrical contact with a second rotating electrical contact ring 44 that is in electrical communication with a second electrical terminal of the electrical device, when the mounting plate 110 of the contact assembly 100 is in the attached position. Referring in particular to FIG. 4, the first and second conductive brushes 142 and 144 may be joined to a yoke 141, while being electrically insulated from the yoke 141, and the yoke 141 is operatively connected to and movable by the actuator 130.

When the contact assembly 100 is moved from a detached position as shown in FIGS. 6A and 7 to the attached position shown in FIGS. 2, 3B, 4, and 5A, whereby the mounting plate 110 is joined to the lower housing 13 of the machine tool 10, the first electrical contact 122 disposed in the mounting plate 110 is electrically connected with a first mating electrical contact 22 disposed in, but insulated from, the housing 13 of the machine tool 10, the second electrical contact 124 disposed in the mounting plate 110 is electrically connected with a second mating electrical contact 24 disposed in, but insulated from, the housing 13 of the machine tool 10, and the first energy supply connection 112 disposed in the mounting plate 110 is connected to a first mating energy supply connection 12 disposed in the housing 13 of the machine tool 10. In other words, the simple act of moving the contact assembly 100 from the detached position to the attached position with the mounting plate 110 joined to the lower housing 13 "plugs in", i.e. removably joins the respective electrical contacts and the energy supply connections with one simple motion.

In certain embodiments, the actuator 130 may be a fluidic actuator, i.e., an actuator operable by delivering fluid under pressure into an actuator body 131 to drive a member 133 in a first direction, and withdrawing fluid under vacuum from the actuator body 131 to drive the member 133 in a second direction opposite the first direction. The member 133 may be a rod that is connected to the yoke 141, which is connected to the brushes 142 and 144 as described previously. In such embodiments, the first energy supply connection 112 may be comprised of a first tubing connector 112 disposed in the mounting plate 110 and connectable with a first mating tubing connector 12 disposed in the housing 13 of the machine tool 10. The first tubing connector 112 and first mating tubing connector 12 may be a matched pair of quick connect fittings, or they may be dimensioned to achieve an interference fit and seal (such as with slightly tapered fittings used in syringe and hypodermic needle connections) when the contact assembly 100 is placed in the installed position. The fluid may be a compressible fluid, i.e., a gas such as air, in which case the fluid actuator 130 is a pneumatic actuator, such as a pneumatic cylinder. Alternatively, the fluid may be an incompressible fluid, i.e., a liquid, in which case the fluid actuator 130 is a hydraulic actuator, such as a hydraulic cylinder.

Referring again to FIGS. 5B-7, the contact assembly 100 may be further comprising a second energy supply connection 114 disposed in the mounting plate 110 and in communication with the actuator 130. In such embodiments, when the mounting plate 110 is moved from the detached position to the attached position and is joined to the housing 13 of the machine tool 10, the second energy supply connection 114 disposed in the mounting plate 110 is connected with a second mating energy supply connection 14 disposed in the housing 13 of the machine tool 10. In such embodiments in which the actuator 130 is a pneumatic or hydraulic actuator, the second energy supply connection 114 may be comprised of a second tubing connector 114 disposed in the mounting plate 110 and connectable with a second mating tubing connector 14 disposed in the housing 13 of the machine tool 10.

In the exemplary embodiment depicted in the drawings, and in FIG. 4 in particular, the actuator 130 is a pneumatic cylinder with fluid ports 132 and 134 at opposed ends of the cylinder. Ports 132 and 134 are connected to the first and second energy supply connection 112 and 114 respectively, via pieces of fluid tubing or via passageways bored in structural members of the contact assembly 100. For the sake of simplicity of illustration, such tubing connections or passageways are not shown.

In other embodiments, the actuator 130 of the contact assembly may be an electrically operated actuator, such as a solenoid, or an electric motor. For example, referring again to FIG. 4, the actuator 130 may be a solenoid having electrical connections 132 and 134, which are connected to the first and second energy supply connection 112 and 114 respectively, via wires (not shown) or via printed circuit boards on structural members of the contact assembly 100. In such an embodiment, the first and second energy supply connections 112 and 114 are electrical connectors that are insulated from the mounting plate 110, and the first and second mating energy supply connections 12 and 14 are electrical connectors that are insulated from the lower housing 13.

The actuator 130, whether fluidic, electrically, or otherwise operated, may be a linear actuator or a rotary actuator. In a further embodiment (not shown), the first brush assembly 143 of the contact assembly 100 may be comprised of a first arm including a proximal end pivotably joined to the mounting plate 110 and a distal end joined to the first conductive brush 142, and a second arm including a proximal end pivotably joined to the mounting plate 110 and a distal end joined to the second conductive brush 144. The first and second arms may be made of an electrically conductive flexible material, such as a spring steel, so as to provide a constant loading of the brushes 142 and 144 on the respective electrical contact rings 42 and 44, as the brushes 142 and 144 wear during operation of the machine tool 10.

Referring to FIGS. 3B, 4, and 6A-7, and in the embodiment depicted therein, the contact assembly 100 may be further comprised of a second actuator 135 that is connected to a second brush assembly 147 comprised of brushes 146 and 148 connected to a yoke 145. The brushes 146 and 148 are in electrical contact with electrical contact rings 46 and 48 on the lower portion 22 of the spindle 20 of the machine tool 10. The second actuator 135 may be connected in parallel with the first actuator 130 to the energy supply connection(s), the brushes 146 and 148 may be connected in parallel with respective brushes 142 and 144 to the respective first and second electrical contacts 122 and 124 disposed in the mounting plate 110, and the electrical contact rings 46 and 48 on the lower portion 22 of the spindle 20 may be connected in parallel with respective electrical contact rings 42 and 44 to the electrical device 30, such as the ultrasonic transducer 30. In that manner, a redundant electrical connection is made between the first and second mating electrical contacts 22 and 24 in housing 13 and the electrical device 30. In other embodiments, the additional pair of brushes 146 and 148 may not be used as a parallel connection to the electrical device 30, but are instead used to provide electrical power and/or signals to another electrical device, or electrical signals from the device, if it is a sensor.

The actuators 130 and 135 may be mounted in housings 113 and 117, which may be spaced apart by a separator block 115. The housings 113 and 117, and the separator block 115 are joined to the mounting plate 110. Each of the housings 113 and 117 are provided with openings at the distal ends thereof for the respective ends 141A/141B and 145A/145B of the yokes 141 and 145 to extend therethrough. In an embodiment in which the actuators 130 and 135 are electrical actuators, the housings 113 and 117 may be made of an electrically insulating material.

Referring again to FIGS. 5B, 6B, and 6C, in certain embodiments, the contact assembly 100 may be further comprised of a third electrical contact 119 disposed in and insulated from the mounting plate. In such embodiments, when the mounting plate 110 is moved from the detached position to the attached position and is joined to the housing 13 of the machine tool 10, the third electrical contact 119 is electrically connected with a third mating electrical contact 19 disposed in the housing 13 of the machine tool 10. Additional pairs of "plug in" electrical contacts may be provided in the same manner. These electrical contact(s) in the mounting plate 110 can be connected to a sensor(s) (not shown) that senses at least one operating parameter on the machine tool 10.

To removably join the mounting plate 110 and the remainder of the contact assembly 100 joined thereto in the attached position to the housing 13 of the machine tool 10, various standard fasteners, such as threaded fasteners (not shown) may be used. To enhance the "quick change" capability of the contact assembly, magnetic fastening may be used. In certain embodiments, the mounting plate 110, or a portion thereof, may include a magnetic material. In such embodiments, the mounting plate may be removably joinable to the housing of the machine tool by movement of a magnet on the housing proximate to the mounting plate. In one exemplary embodiment depicted in FIGS. 4, 5B, and 7, a magnet 70 is rotatably mounted in the housing 13, and joined to a drive shaft 72 that extends outwardly to an outer wall 19 of the housing 13. The end of the shaft 72 has an engagement feature such as a slot or hex socket that is drivable with a tool such as a screwdriver or hex key. Thus with a ¼ turn, the magnet 70 can be rotated to the engagement position shown in FIG. 4, which is the attached position. The close proximity of the pole of the magnet 70 to the mounting plate 110 applies a strong retaining force on the mounting plate 110, thus firmly holding the contact assembly 100 in the attached position. When it is desirable to remove the contact assembly, the magnet 70 can be easily rotated 90 degrees with the tool (not shown), thereby removing the magnetic attachment force on the mounting plate 110. The contact assembly 100 can then be removed from the machine tool.

In machining operations with the machine tool 10, at least two contact assemblies 100 are provided. One is in use on the machine tool 10, and the other is a spare, prepared with new brushes and ready for use. When the brushes of the contact assembly 100 in use are worn down to the point where they must be replaced, the machine tool 10 can be stopped, the magnet shaft 72 rotated a quarter turn, the contact assembly 100 with worn brushes removed, the contact assembly 100 with new brushes "plugged in," and the magnet shaft 72 rotated a quarter turn again to retain the "fresh" contact assembly 100. The machine tool 10 can then be restarted, and machining operations resumed. Advantageously, brush change-out time is reduced from over an hour (in conventional brush change practice) to a few minutes. The brush change procedure is more reliable as well. The risk of misfitting the brushes and/or losing small parts such as brush retaining screws, during the change procedure is eliminated. The brush change procedure with contact assembly 100 is a "plug and play" operation.

In accordance with the present disclosure, a machine tool is provided, comprising a housing 13, a rotating spindle 20 mounted in the housing 13, an electrical device 30 mounted in the rotating spindle 20, and a contact assembly 100 as described herein. The electrical device 30 may be an ultrasonic transducer and an ultrasonic horn joined to a machine tool bit, for performing ultrasonically assisted machining of materials. However, it is to be understood that the modular contact assembly 100 of the present disclosure is not limited to use only with a machine tool. The contact assembly 100 is adaptable to any use where electrical brushes and rotating slip rings are used to transfer electrical energy from a fixed object to a rotating object, and where it would be advantageous to have the brush "quick change" capability provided by the contact assembly 100.

It is therefore apparent that there has been provided, in accordance with the present disclosure, a modular contact assembly for transferring electrical energy from a fixed object to a rotating object, and a machine tool that includes the contact assembly. The foregoing description of technology and the invention is merely exemplary in nature of the subject matter, manufacture, and use of the invention and is not intended to limit the scope, application, or uses of any specific invention claimed in this application or in such other applications as may be filed claiming priority to this application, or patents issuing therefrom. The following definitions and non-limiting guidelines must be considered in reviewing the description.

The headings in this disclosure (such as "Background" and "Summary") and sub-headings used herein are intended only for general organization of topics within the present technology, and are not intended to limit the disclosure of the present technology or any aspect thereof. In particular, subject matter disclosed in the "Background" may include novel technology and may not constitute a recitation of prior art. Subject matter disclosed in the "Summary" is not an exhaustive or complete disclosure of the entire scope of the technology or any embodiments thereof. Classification or discussion of a material within a section of this specification as having a particular utility is made for convenience, and no inference should be drawn that the material must necessarily or solely function in accordance with its classification herein when it is used in any given composition.

To the extent that other references may contain similar information in the Background herein, said statements do not constitute an admission that those references are prior art or have any relevance to the patentability of the technology disclosed herein. Any discussion in the Background is intended merely to provide a general summary of assertions.

The description and specific examples, while indicating embodiments of the technology disclosed herein, are intended for purposes of illustration only and are not intended to limit the scope of the technology. Moreover, recitation of multiple embodiments having stated features is not intended to exclude other embodiments having additional features, or other embodiments incorporating different combinations of the stated features. Specific examples are provided for illustrative purposes of how to make and use the compositions and methods of this technology and, unless explicitly stated otherwise, are not intended to be a representation that given embodiments of this technology have, or have not, been made or tested.

To the extent employed herein, the words "preferred" and "preferably" refer to embodiments of the technology that afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the technology.

Unless otherwise specified, relational terms used in the present disclosure should be construed to include certain tolerances that those skilled in the art would recognize as providing equivalent functionality. By way of example, the term perpendicular is not necessarily limited to 90.00°, but also to any variation thereof that those skilled in the art would recognize as providing equivalent functionality for the purposes described for the relevant member or element. Terms such as "about" and "substantially" in the context of configuration relate generally to disposition, location, and/or configuration that is either exact or sufficiently close to the location, disposition, or configuration of the relevant element to preserve operability of the element within the invention while not materially modifying the invention. Similarly, unless specifically specified or clear from its context, numerical values should be construed to include certain tolerances that those skilled in the art would recognize as having negligible importance, as such do not materially change the operability of the invention.

Having thus described the basic concept of the invention, it will be apparent to those skilled in the art that the foregoing detailed disclosure is intended to be presented by way of example only, and is not limiting. Various alterations, improvements, and modifications will occur to those skilled in the art, though not expressly stated herein. These alterations, improvements, and modifications are intended to be suggested hereby, and are within the spirit and scope of the invention. Additionally, the recited order of processing elements or sequences, or the use of numbers, letters, or other designations therefore, is not intended to limit the claimed processes to any order except as may be expressly stated in the claims.

We claim:

1. For a machine tool comprising a housing, a rotating spindle mounted in the housing, and an electrical device mounted in the rotating spindle, a contact assembly comprising:

a) a mounting plate joinable to the housing by movement of the plate into an attached position on the housing;

b) a first brush assembly joined to the mounting plate and comprising a first conductive brush movable with respect to the mounting plate and a second conductive brush movable with respect to the mounting plate;

c) a first electrical contact disposed in the mounting plate and in electrical communication with the first conductive brush;

d) a second electrical contact disposed in the mounting plate and in electrical communication with the second conductive brush;

e) an actuator joined to the mounting plate and operable to move the first conductive brush into electrical contact with a first rotating electrical contact ring in electrical communication with the electrical device, and operable to move the second conductive brush into electrical contact with a second rotating electrical contact ring in electrical communication with the electrical device, when the mounting plate is in the attached position; and f) a first energy supply connection disposed in the mounting plate and in communication with the actuator;

wherein when the mounting plate is moved from a detached position to the attached position and is joined to the housing of the machine tool, the first electrical contact disposed in the mounting plate is electrically connected with a first mating electrical contact disposed in the housing of the machine tool, the second electrical contact disposed in the mounting plate is electrically connected with a second mating electrical contact disposed in the housing of the machine tool, and the first energy supply connection disposed in the mounting plate is connected to a first mating energy supply connection disposed in the housing of the machine tool.

2. The contact assembly of claim 1, wherein the actuator is a fluidic actuator, and wherein the first energy supply connection is comprised of a first tubing connector disposed in the mounting plate and connectable with a first mating tubing connector disposed in the housing of the machine tool.

3. The contact assembly of claim 2, wherein the fluidic actuator is a pneumatic actuator.

4. The contact assembly of claim 1, wherein the actuator is an electrically operated actuator.

5. The contact assembly of claim 4, wherein the electrically operated actuator is a solenoid actuator.

6. The contact assembly of claim 4, wherein the electrically operated actuator is an electric motor.

7. The contact assembly of claim 1, further comprising a second energy supply connection disposed in the mounting plate and in communication with the actuator, wherein when the mounting plate is moved from the detached position to the attached position and is joined to the housing of the machine tool, the second energy supply connection disposed in the mounting plate is connected with a second mating energy supply connection disposed in the housing of the machine tool.

8. The contact assembly of claim 7, wherein the actuator is a pneumatic actuator, and wherein the first energy supply connection is comprised of a first tubing connector disposed in the mounting plate and connectable with a first mating tubing connector disposed in the housing of the machine tool, and the second energy supply connection is comprised of a second tubing connector disposed in the mounting plate and connectable with a second mating tubing connector disposed in the housing of the machine tool.

9. The contact assembly of claim 1, wherein the actuator is a linear actuator.

10. The contact assembly of claim 1, wherein the first brush assembly is comprised of a first arm including a proximal end pivotably joined to the mounting plate and a distal end joined to the first conductive brush, and a second arm including a proximal end pivotably joined to the mounting plate and a distal end joined to the second conductive brush.

11. The contact assembly of claim 1, wherein the mounting plate includes a magnetic material, and wherein the mounting plate is removably joinable to the housing of the machine tool by movement of a magnet on the housing proximate to the mounting plate.

12. The contact assembly of claim 1, further comprising a third electrical contact disposed in the mounting plate, wherein when the mounting plate is moved from the detached position to the attached position and is joined to the housing of the machine tool, the third electrical contact disposed in the mounting plate is electrically connected with a third mating electrical contact disposed in the housing of the machine tool.

13. The contact assembly of claim 12, wherein the third electrical contact is operable to transmit an electrical signal of a sensor on the machine tool.

14. A machine tool comprising a housing, a rotating spindle mounted in the housing, an electrical device mounted in the rotating spindle, and a contact assembly comprising:

a) a mounting plate joinable to the housing by movement of the plate into an attached position on the housing;

b) a first brush assembly joined to the mounting plate and comprising a first conductive brush movable with respect to the mounting plate and a second conductive brush movable with respect to the mounting plate;

c) a first electrical contact disposed in the mounting plate and in electrical communication with the first conductive brush;

d) a second electrical contact disposed in the mounting plate and in electrical communication with the second conductive brush;

e) an actuator joined to the mounting plate and operable to move the first conductive brush into electrical contact with a first rotating electrical contact ring in electrical communication with the electrical device, and operable to move the second conductive brush into electrical contact with a second rotating electrical contact ring in electrical communication with the electrical device, when the mounting plate is in the attached position; and f) a first energy supply connection disposed in the mounting plate and in communication with the actuator;

wherein when the mounting plate is moved from a detached position to the attached position and is joined to the housing of the machine tool, the first electrical contact disposed in the mounting plate is electrically connected with a first mating electrical contact disposed in the housing of the machine tool, the second electrical contact disposed in the mounting plate is electrically connected with a second mating electrical contact disposed in the housing of the machine tool, and the first energy supply connection disposed in the mounting plate is connected to a first mating energy supply connection disposed in the housing of the machine tool.

15. The machine tool of claim 14, wherein the electrical device is an ultrasonic transducer.

* * * * *